United States Patent [19]

Pastor

[11] Patent Number: 4,466,611

[45] Date of Patent: Aug. 21, 1984

[54] ACTIVE PHYSIOTHERAPEUTIC DEVICE

[76] Inventor: Angel A. Paster, Paseo Marítimo 37, Edificio Luz, Málaga, Spain

[21] Appl. No.: 303,936

[22] Filed: Sep. 21, 1981

[30] Foreign Application Priority Data

Sep. 26, 1980 [ES] Spain ..... 253.173
Jan. 24, 1981 [ES] Spain ..... 255.767
Apr. 24, 1981 [ES] Spain ..... 257.863

[51] Int. Cl.[3] ..... A63B 23/00
[52] U.S. Cl. ..... 272/96; 272/142
[58] Field of Search ..... 272/141, 142, 130, 96, 272/DIG. 4, 70

[56] References Cited

U.S. PATENT DOCUMENTS 4,111,416 9/1978 Jinotti ..... 272/141
4,159,111 6/1979 Lowth ..... 272/96
4,279,415 7/1981 Katz ..... 272/141 X

*Primary Examiner*—Richard C. Pinkham
*Assistant Examiner*—Matthew L. Schneider
*Attorney, Agent, or Firm*—Wigman & Cohen

[57] ABSTRACT

Active physiotherapeutic apparatus for the rehabilitation of lower extremities and improving blood circulation comprising a base member upwardly inclined and a pair of foot operated pedals pivotably mounted thereon. In one embodiment, an elbow-shaped lever is pivoted beneath each pedal. One end of each lever carries a sheave which bears against the underside of a pedal. The other end of each lever is connected to a tension spring. Repeatedly depressing the pedals against the force of the tension spring acting through the lever and sheave results in the aforementioned therapeutic benefits.

3 Claims, 4 Drawing Figures

ACTIVE PHYSIOTHERAPEUTIC DEVICE

BACKGROUND OF THE INVENTION

The present invention relates to an active physiotherapeutic apparatus for the rehabilitation and prophylaxis of diseases of the lower extremities involving venous, arterial or osteomuscular problems, as well as for improving blood circulation and in connection with medical, cardiac and similar tests.

SUMMARY OF THE INVENTION

The apparatus of the present invention has been specially designed for the prophylaxis and treatment of osteoarticular and muscular diseases and those involving blood circulation in general, whether venous, arterial or cardiac, requiring an active movement of flexion-extension of the joint of the foot predominantly, while movement of the knee is kept at a minimum and that of the hip virtually completely nil.

This apparatus comprises a base having a plane inclined toward the user on which are mounted to rotate at their lower end pedals, arranged virtually parallel to one another and provided on their lower part with elastic means that continually push towards a higher position.

According to one embodiment the apparatus of the present invention allows adjustment at will of the resistance the foot must overcome to cause it to descend. This adjustment may be complemented, if desired, with mechanical or electronic systems for measuring and controlling the strain.

So that the invention may be better understood, reference is made to the following detailed description of the invention, the appended claims and to the several drawings attached herein.

DETAILED DESCRIPTION OF A PREFERRED EMBODIMENT

With reference to the drawings, it may be observed that the invention comprises a base, having an upper face 1 which is an inclined plane. On the lower part of the plane are mounted two rotatable pedals 3 and 4 preferably provided with heel guards 5 to prevent the feet from slipping.

Foot pedals are provided with elastic means on their under surface to constantly push them towards their upper position. In this manner, the resistance of the elastic means must be overcome in order to descend when the user moves his feet.

Figure 2:
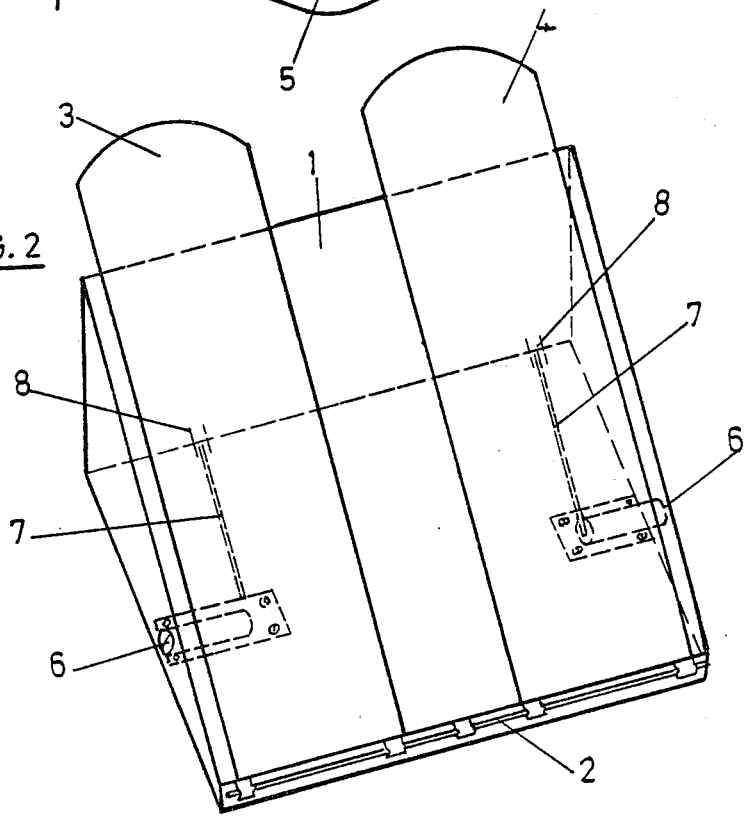
FIGS. 2, 3 and 4 are perspective views of alternative forms of the present invention and the means for activating the pedal position.

According to FIG. 2, the aforementioned elastic means consist of two hydraulic cylinders 6 constructed with adjustable-pitch pistons which act on the connecting rods 7 to transmit a force to the pedals 3 and 4 by means of sheaves 8 mounted on the free ends of each rod 7. By means of this system, it is possible to adjust the effort that must be made on each of the pedals independently. Pedals 3 and 4 are pivotably secured to base 1 by pivot means 2.

Figure 3:
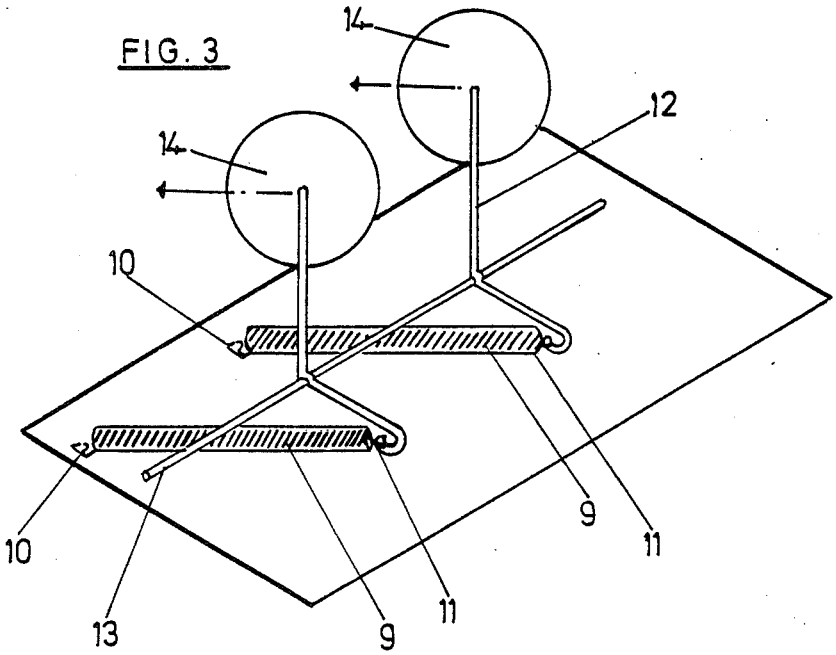

Referring now to FIG. 3, it will be seen that the flexible means consist of two extension springs 9, each attached to the base at one end 10, while at the other end 11 it is connected to the end of the lower portion of lever member 12, which in turn is rotatably mounted on a rod 13. The upper portion of lever member 12 is provided with sheaves 14 that act on the respective pedals (not shown).

As will be appreciated, the elastic means may also be simple springs.

Figure 4:
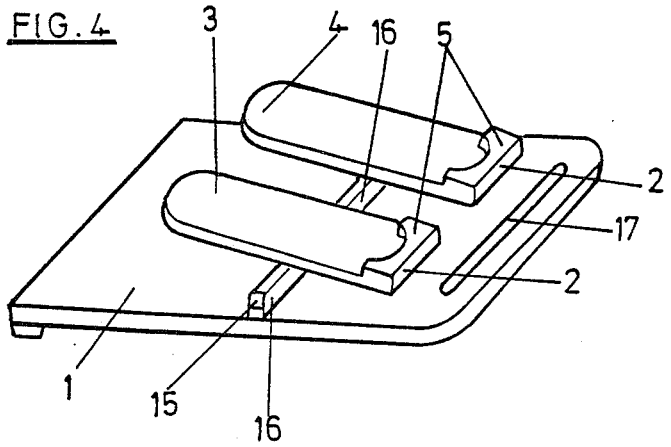

In FIG. 4, it will be seen that the elastic means consist of an elastic band 15 mounted as a bridge between three projections 16 formed on the base 1.

In FIG. 3, the elastic means comprises a draw spring 9 activated through an elbow-shaped lever 12 ending at its free end in a sheave 14 over which the pedal 3 acts.

Figure 1:
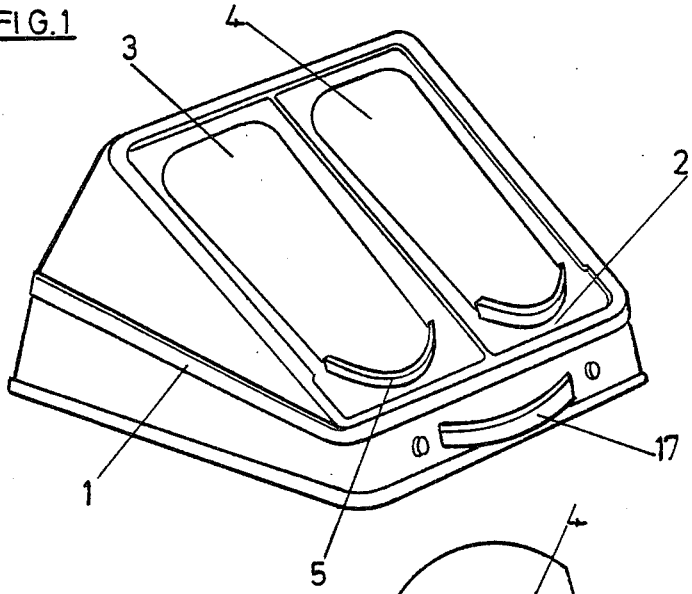
FIG. 1 is a perspective view of one embodiment in which the apparatus is in the form of a carrying case.

As shown in FIGS. 1 and 4, it is possible to equip the apparatus with a handle 17 to facilitate its transport.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. Active physiotherapeutic apparatus for the rehabilitation of lower extremities and improving blood circulation, comprising:

a base inclined upwardly towards the user, two pedals with heel guards mounted to rotate at their lower part on the base, said pedals being urged upwardly by elastic means whereby said pedals pivot when activated by the user's feet to overcome the resistance of the elastic means and are restored to their initial position when the user's foot stops exerting pressure, wherein said elastic means comprises a draw spring activated through an elbow-shaped lever ending at its free end in a sheave over which the pedal acts.

2. Apparatus according to claim 1, wherein said draw spring comprises a flexion spring.

3. A method for the rehabilitation of the lower extremities and toning of blood circulation of humans comprising the steps of providing apparatus as recited in claim 1, repeatedly activating and deactivating the pedals by placing a foot on each pedal for a predetermined period of time.

* * * * *

UNITED STATES PATENT AND TRADEMARK OFFICE

CERTIFICATE OF CORRECTION

PATENT NO. : 4,466,611

DATED : August 21, 1984

INVENTOR(S) : Angel Almansa Pastor

It is certified that error appears in the above—identified patent and that said Letters Patent is hereby corrected as shown below:

Heading of Page 1 after [19], please change name of inventor from "Pastor" to --Almansa Pastor--.

Page 1, line 2 [76] Inventor:, please change "Angel A. Paster" to --Angel Almansa Pastor--.

Signed and Sealed this

*Nineteenth* Day of *February 1985*

[SEAL]

*Attest:*

DONALD J. QUIGG

*Attesting Officer* *Acting Commissioner of Patents and Trademarks*